United States Patent [19]

Sokalski

[11] Patent Number: 4,714,752

[45] Date of Patent: Dec. 22, 1987

[54] 2,2-BIS (4 HYDROXYPHENYL) ALKYL POLY DERIVATIVES FOR USE IN AFTER-TREATMENT OF CONVERSION COATED METALS

[75] Inventor: Stanley M. Sokalski, Southfield, Mich.

[73] Assignee: Detrex Corporation, Southfield, Mich.

[21] Appl. No.: 890,916

[22] Filed: Jul. 28, 1986

[51] Int. Cl.[4] ..... C23C 22/82

[52] U.S. Cl. ..... 528/153; 528/162; 148/6.14 R

[58] Field of Search ..... 528/162, 153; 148/6.14 R

[56] References Cited

U.S. PATENT DOCUMENTS

| | | | |
|---|---|---|---|
| 2,585,197 | 2/1952 | Walton | 528/162 |
| 2,743,252 | 4/1956 | Groote | 528/162 |
| 2,890,095 | 6/1959 | Meister | 528/162 |
| 3,364,179 | 1/1968 | Kirkpatrick | 528/162 |
| 3,436,373 | 4/1969 | Cox | 528/162 |
| 3,462,237 | 8/1969 | Sellet | 528/162 |
| 3,878,136 | 4/1975 | Höfl | 528/163 |
| 4,517,028 | 5/1985 | Lindert | 148/6.15 R |
| 4,613,384 | 9/1986 | John | 148/6.14 R |

*Primary Examiner*—Sam Silverberg
*Attorney, Agent, or Firm*—Paul and Paul

[57] ABSTRACT

A solution comprising an effective amount of a water soluble or water dispersible compound selected from the group consisting of polymeric compounds generally described as substituted poly [[2,2-bis (4 hydroxyphenyl)]] alkyl materials as well as acid salts thereof and mixtures thereof, which solution is useful for treating metal surfaces to impart corrosion resistance and paint adhesion characteristics and processes for manufacturing and using the same.

12 Claims, No Drawings

2,2-BIS (4 HYDROXYPHENYL) ALKYL POLY DERIVATIVES FOR USE IN AFTER-TREATMENT OF CONVERSION COATED METALS

BACKGROUND OF THE INVENTION

The present invention relates to the art of metal surface treatment. More specifically, the present invention relates to the after-treatment of metals which have been subjected to a conversion coating step and to a novel polymeric after-treatment solution or dispersion for application to metals which have been treated with conversion coatings.

The need for applying protective coatings to metal surfaces for improved corrosion resistance and paint adhesion characteristics is well-known in the metal finishing and other metal arts. The usual technique for forming such protective coatings on metal surfaces involves contacting the metal surface with a solution containing phosphate ions to form a corrosion resistant, nonreactive, phosphate complex coating on the metal surface. Such coatings convert the metal surface from a chemically active surface readily susceptible to oxidation and corrosion and are known in the art as "conversion coatings".

The corrosion-resistance provided by conversion coatings can be enhanced by treating the phosphatized metal surface with an after-treatment solution such as a dilute aqueous acidic solution containing hexavalent chromium ions. However, although chromium after-treatment solutions and processes are known to be effective, there is a problem which arises from the effluents. Because of the toxic nature of hexavalent chromium compounds, expensive treatment equipment and processes must be used to remove the chromates from plant effluents in order to prevent the pollution of rivers, streams and drinking water sources. Hence, although the corrosion resistance and the paint adhesion characteristics of conversion coated metal surfaces can be enhanced by an after-treatment solution containing hexavalent chromium compounds, in recent years there have been research and development efforts directed to discovering effective alternative after-treatment systems to the known chromium containing after-treatment solutions.

One such class of compounds consists of derivatives of 4-vinylphenol in polymer form as disclosed in U.S. Pat. No. 4,433,015. However, the use of such monohydroxy phenyl compounds in the after-treatment of phosphatized metals presents a very real problem because of the difficulty in synthesizing such compounds in a form which will avoid the presence of significant amounts of unreacted phenol in the effluent. Such unreacted phenol presents contamination problems comparable to or even worse than the problems involved in the use of hexavalent chromium after-treatment compounds. The same is true of monohydroxy phenyl compounds of the type shown in U.S. Pat. Nos. 4,457,790 and 4,517,028. The problem in all such cases is that the process of making such monohydroxy compounds becomes very expensive if the pollution problems referred to above are to be avoided. Therefore, considerable effort has been devoted to developing after-treatment products which do not leave significant amounts of unreacted phenol in the effluent and at the same time provide after-treatment products which are easier and cheaper to manufacture than those heretofore known and which are easier to use.

SUMMARY OF THE INVENTION

In accordance with the present invention a novel composition and process involving an alternative to the use of hexavalent chromium compounds and monohydroxy phenyl compounds is provided for use as an after-treatment step in a novel process for the post-treatment of phosphatized or conversion coated metal surfaces. Further understanding of this invention will be had from the following disclosure wherein all parts and percentages are by weight unless otherwise indicated.

A process for treating metals is provided which includes the use of a novel after-treatment solution which avoids the use of hexavalent chromium compounds and monohydroxy phenyl compounds. The invention includes a group of after-treatment compounds suitable for use in such after-treatment solutions or dispersions. These consist of soluble or dispersible compounds selected from the group consisting of a polymer or group of polymers having the general formulae hereinafter set forth based upon 2,2-bis(4 hydroxyphenyl)alkyl (such as propane or butane) derivatives.

A general formula of one embodiment of a class of after-treatment compounds coming within the scope of the present invention is:

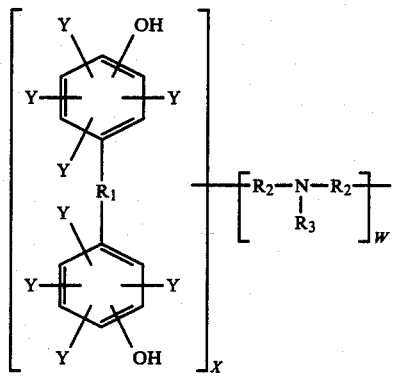

in which:

$R_1$ is an alkyl group having from 1 to about 5 carbon atoms;

$R_2$ is an alkyl group having from 1 to about 5 carbon atoms;

$R_3$ is an alkyl or hydroxy alkyl group having from 1 to about 5 carbon atoms;

Each Y is: hydrogen, or Z or $CR_4R_5OR_6$ or $CH_2Cl$, or an alkyl group having from 1 to 18 carbon atoms, or an aryl group;

Z is represented in the following general formula:

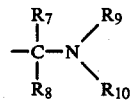

where $R_4$ through $R_{10}$ are hydrogen, or an alkyl, aryl, hydroxy-alkyl, amino-alkyl, mercapto-alkyl or phospho-alkyl moiety, said $R_4$ through $R_{10}$ being of carbon chain lengths up to a length at which the compound is not soluble or dispersible; and X is from 2 up to a number at which the polymer is not soluble or dispersible.

Preferably, the solution is an aqueous solution and "Z" moieties are present in sufficient amount that the compound is water soluble or water dispersible. Metal surfaces contacted with the solution have enhanced corrosion resistance and paint adhesion characteristics.

A general formula of a second embodiment of after-treatment compounds coming within the scope of the present invention is:

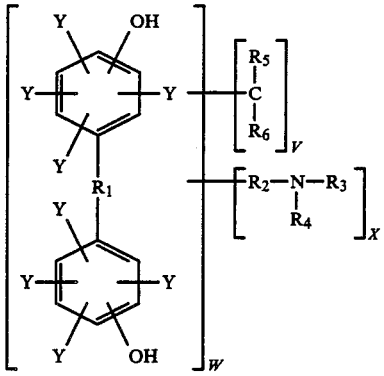

$R_1$ is an alkyl group having from 1 to about 5 carbon atoms;

$R_2$ is an alkyl group having from 1 to about 5 carbon atoms;

$R_3$ is an alkyl or hydroxy alkyl group having from 1 to about 5 carbon atoms;

Each Y is: hydrogen, or Z, $CR_4R_5OR_6$ or $CH_2Cl$, or an alkyl group having from 1 to 18 carbon atoms, or an aryl group;

Z is represented in the following general formula:

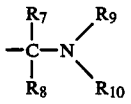

$R_4$ through $R_{10}$ are hydrogen, or an alkyl, aryl, hydroxy-alkyl, amino-alkyl, mercapto-alkyl or phospho-alkyl moiety, said $R_4$ through $R_{10}$ being of carbon chain lengths up to a length at which the compound is not soluble or dispersible; and W is from 2 up to a number at which the polymer is not soluble or dispersible;

V is approximately equal to W; and

X is from 0.5 to about 4 times W.

Preferably, the solution is an aqueous solution and "Z" moieties are present in sufficient amount that the compound is water soluble or water dispersible. Metal surfaces contacted with the solution have enhanced corrosion resistance and paint adhesion characteristics.

DETAILED DESCRIPTION OF THE INVENTION

Processes and solutions for forming conversion coatings on metal surfaces are well-known and have been described, for example, in Metal Handbook, Volume II, 8th Edition, pages 529–547 of the American Society for Metals and in Metal Finishing Guidebook and Directory, pages 674–687 (1981). The contents of both of these publications are specifically incorporated herein by reference.

Typically, a conversion coating involves the following steps:

1. Cleaning;
2. Water rinsing;
3. Formation of the conversion coating by contact with a suitable phosphate, chromate, or similar conventional bath;
4. Water rinsing;
5. Applying a post-treatment solution; and
6. Optionally, drying the surface.

The present invention includes the step of applying an after-treatment solution or dispersion to a metal surface to which a conversion coating has previously been applied. Thus, the present invention provides an after-treatment composition which is well adapted, when in dilute solution or dispersion form, for use in a process wherein a conversion coated metal surface is contacted therewith to improve the corrosion resistance and paint adhesion characteristics of the metal surface. The present invention is useful with a broad range of types of conversion coated metal surfaces. Examples of metals having surfaces which can be conversion coated with suitable conversion coating compositions include zinc, iron, aluminum and cold-rolled, ground, pickled, and hot-rolled steel and galvanized steel. Examples of conversion coating solutions include solutions comprising iron phosphate, magnesium phosphate, zinc phosphate, and zinc phosphate modified with calcium or magnesium ions.

In a typical metal treatment operation employing a composition and process of this invention, the metal to be treated is initially cleaned by a chemical or physical process to remove grease and dirt from the surface. Following this cleaning process, a conversion coating solution is applied in a conventional manner. The conversion coated surface is then rinsed and the after-treatment solution of the present invention is immediately applied.

The after-treatment composition of the present invention is a solution or dispersion of a polymeric compound which may be generally represented as a substituted poly[2,2-bis(4-hydroxyphenyl]propane or butane.

The treatment compounds of this invention are soluble in organic solvents and can be used as a treatment solution when dissolved in an organic solvent as, for example, ethanol. Advantageously, however, the treatment compounds can also be used in aqueous medium. To provide water solubility or water dispersibility of the compound, an organic or inorganic acid can be used for neutralization of the "Z" moiety thereof. Useful acids for this purpose are acetic acid, citric acid, oxalic acid, ascorbic acid, phenylphosphonic acid, chloromethylphosphonic acid; mono, di and trichloroacetic acid, trifluoroacetic acid, nitric acid, phosphoric sacid, hydrofluoric acid, sulfuric acid, boric acid, hydrochloric acid, hexafluorosilicic acid, hexafluorotitanic acid, hexafluorozirconic acid, and the like; alone or in combination with each other. The addition of water to the neutralized, overneutralized or partially neturalized treatment compounds mentioned above results in a water soluble or dispersible solution or emulsion of the polymer useful for metal treatment.

The pH of the aqueous solution can vary, but for practical purposes is kept between pH 2.0 to pH 8.0 both for the stability of the solution and for best results on the treated metal surface.

It is contemplated that the treatment compound of the present invention will generally be used in a working solution at a dilute concentration of, for example, from about 0.01% to about 5% by weight. Practically speaking, a concentration of 0.025% to 1% is preferred in a working solution. However, under some circumstances, for example, for transporting or storing the solution, a concentrate of the solution may be preferred.

Application of the treatment solution of the present invention in the after-treatment of phosphated metal surfaces can be carried out by any conventional method. While it is contemplated that the metal surface will preferably be a conversion coated metal surface, the treatment step can alternatively be carried out on an untreated metal surface to improve the corrosion resistance and paint adhesion thereof. For example, the treatment solution can be applied by spray coating, roller coating, or dipping. The temperature of the solution applied can vary over a wide range, but is preferably from about 70° F. to about 160° F. After application of the treatment solution to the metal surface, the surface can optionally be rinsed, although good results can be obtained without rinsing after treatment. For some end uses, for example, in electrocoat paint application, rinsing may be preferred.

Next, the treated metal surface is dried. Drying can be carried out by, for example, circulating air or by oven drying. While room temperature drying can be employed, it is preferable to use elevated temperatures to decrease the amount of drying time required.

After drying, the treated metal surface is ready for painting or the like. The surface is suitable for standard paint or other coating application techniques such as brush paint, spray paint, electro-static coating, dipping, roller coating, as well as electrocoating. As a result of the after-treatment step of the present invention, the conversion coated surface has improved paint adhesion and corrosion resistance characteristics.

EXAMPLES ILLUSTRATING PREPARATION OF THE AFTER-TREATMENT MATERIALS OF THE PRESENT INVENTION

The following examples describe the preparation of representative after-treatment compounds of the present invention.

EXAMPLE 1

600 grams of isopropyl alcohol and 400 grams of water were charged into a jacketed glass resin kettle equipped with a stirrer, condenser, and thermometer. 68.5 grams of 2,2-bis(4-hydroxyphenyl)propane and 73.3 grams of monoethanolamine were then added to the contents of the kettle. The kettle was then heated to about 82° C. while the contents were stirred and allowed to dissolve. 195 grams of 37% formaldehyde were then added slowly over a period of about one hour. After the last addition of formaldehyde, the solution was kept at about 82° C. for about five hours. The solution was then cooled to about 40° C. 12 grams of concentrated nitric acid was then diluted with 100 grams of water. The diluted nitric acid was added to the material in the resin kettle. Additional deionized water was added to bring the concentration in the kettle to about 10% solids. There resulted an after-treatment concentrate suitable for use in the practice of the present invention.

The final after-treatment material may be represented by the formula poly[[2,2-bis(4-hydroxphenyl)-propane]iminoethanol]. Since this final material is a polymer, it is important to take into account the required parameters. The product of this invention must be soluble or dispersible in water at a concentration of about 0.5 to about 2 grams per liter. In addition, the pH should be between about 3 and about 8 and preferably between about 4.5 and about 6.5. It is important to observe these conditions since if the reaction is allowed to proceed too far an insoluble product will be formed.

EXAMPLE 2

The process of Example 1 was followed using 23.6% 2,2-bis(4 hydroxyphenyl)propane, 38.7% monoethanolamine and 37.7% formaldehyde.

EXAMPLE 3

The process of Example 1 was followed using 21.2% 2,2-bis(4 hydroxyphenyl)propane, 39.8% monoethanolamine and 39.0% formaldehyde.

EXAMPLE 4

The process of Example 1 was followed using 18.7% 2,2-bis(4 hydroxyphenyl)propane, 39.9% monoethanolamine and 41.4% formaldehyde.

In Example 1 the structural formula for the after-treatment compound thus obtained corresponds to the general formula set forth at page 4. The treatment material produced in Examples 1 to 4 may be designated as poly[[2,2-bis(b 4 hydroxyphenyl)propane]iminoethanol].

EXAMPLE 5

The process of Example 1 was followed using 114 grams of poly 2,2-bis(4 hydroxyphenyl)propane, 73 grams of monoethanolamine, 60 grams of methoxyethylamine and 120 grams of formaldehyde.

In Example 5 a water soluble after-treatment product of this invention is produced using a mixture of amines. Like all materials of this invention, this product will give dilute solutions in slightly acidic water.

In the above examples 2,2-bis(4 hydroxyphenyl)butane may be substituted in equivalent amount for the 2,2-bis(4 hydroxyphenyl)propane ingredient. Likewise, mixtures of the propane compound and the butane compound may be used in place of either one of the propane or butane compounds taken along. Such substitution will, of course, change the chemical name for the resulting products.

The treatment material obtained in Example 5 may be designated as poly[[2,2-bis(4 hydroxyphenyl)-propane]iminoethanol/iminomethoxyethanol]. Where 2,2-bis(4 hydroxphenyl)butane is used as the starting material the ultimate product is a poly[2,2-bis(4 hydroxphenyl)]butane substitution material.

EXAMPLE 6

The process of Example 1 was followed using 27.7% 2,2-bis(4 hydroxyphenyl)propane, 42.3% amino 2 methyl propanol and 29.1% formaldehyde.

EXAMPLE 7

The process of Example 1 was followed using 29.7% 2,2-bis(4 hydroxyphenyl)propane, 39.0% 3 amino 2 propanol and 31.3% formaldehyde.

EXAMPLE 8

The reaction is carried out in a resin kettle equipped with a heating mantle, stirrer, thermometer and condenser. To a solvent composed of 300 grams of isopropanol and 200 grams of water is added 137 g of 2,2-bis(4 hydroxyphenyl)propane and 10 grams of potassium carbonate. The mixture is heated and stirred until all of the ingredients are dissolved. Then 64.8 g of 37% formaldehyde is added. The solution is heated to about 82° C. for four hours. Without cooling the solution, 135 g of N-methyl ethanolamine is added to the resin kettle. This is followed by 146 g of 37% formaldehyde added slowly over about one hour. The solution is kept at the 82° C. temperature for three hours. The solution is then cooled to 40° C. Then a solution of 24 grams of concentrated nitric acid in 100 g of water is added to the reaction product. The resulting product is then diluted with water to about 10% solids and further neutralized to a pH of about 7.0. The product gives a clear solution when added to water. The product may be designated as poly[(methyl iminoethanol[[2,2-bis(4 hydroxyphenyl)propane])methylene]].

EXAMPLE 9

The process of Example 8 was followed using 74% 2,2-bis(4 hydroxyphenyl)propane, 9.0% formaldehyde, 12.1% N-methyl ethanolamine and 4.9% formaldehyde.

EXAMPLE 10

The process of Example 8 was followed using 62.9% 2,2-bis(4 hydroxyphenyl)propane, 8.3% formaldehyde, 20.6% N-methyl ethanolamine and 8.2% formaldehyde.

EXAMPLE 11

The process of Example 8 was followed using 39.8% 2,2-bis(4 hydroxyphenyl)propane, 5.2% formaldehyde, 39.3% N-methyl ethanolamine and 15.7% formaldehyde.

EXAMPLE 12

The process of Example 8 was followed using 39.1% 2,2-bis(4 hydroxyphenyl)propane, 6.9% formaldehyde, 38.6% N-methyl ethanolamine and 15.4% formaldehyde.

What is claimed is:

1. An aqueous composition including polymeric water soluble or water dispersible material useful in the treatment of metals to enhance the corrosion resistance and paint adhesion characteristics thereof comprising up to about 10% by weight of a polymer which has been polymerized under basic conditions having the general formula:

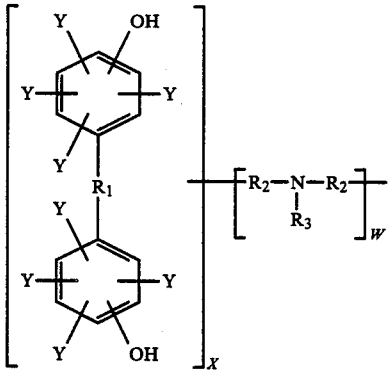

wherein

W and X are each 2 or more up to a number at which the polymer is not soluble or dispersible in water; and in which $R_1$ is an alkyl group having from 1 to about 5 carbon atoms;

$R_2$ is an alkyl group having from 1 to about 5 carbon atoms;

$R_3$ is an alkyl or hydroxyalkyl group having from 1 to about 5 carbon atoms;

each Y is hydrogen, Z, $CR_4R_5OR_6$, $CH_2Cl$, an alkyl group having from 1 to 18 carbon atoms, or an aryl group; and wherein Z is represented by the formula

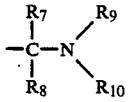

$R_4$ through $R_{10}$ are hydrogen, or an alkyl, aryl, hydroxyalkyl, amino-alkyl, mercapto-alkyl, or phosphoalkyl moiety, said $R_4$ through $R_{10}$ being of carbon chain lengths up to a length at which the polymer is not soluble or dispersible in water; and X is from 2 up to a number at which the polymer is not soluble or dispersible in water.

2. The aqueous composition of claim 1 wherein said material is the reaction product of a 2,2-bis[4 hydroxyphenyl]propane, a secondary amine and formaldehyde.

3. The aqueous composition of claim 1 wherein said material is the reaction product of a 2,2-bis[4 hydroxyphenyl]butane, a secondary amine and formaldehyde.

4. An aqueous composition according to claim 1 including from about 0.01% to 5% by weight of a polymeric material.

5. An aqueous composition according to claim 1 including from about 0.025% to 1% by weight of a polymeric material.

6. An aqueous composition according to claim 1 further including an acid.

7. An aqueous composition including polymeric water soluble or water dispersible material useful in the treatment of metals to enhance the corrosion resistance and paint adhesion characteristics thereof comprising up to about 10% by weight of a polymer which has been polymerized under basic conditions having the general formula:

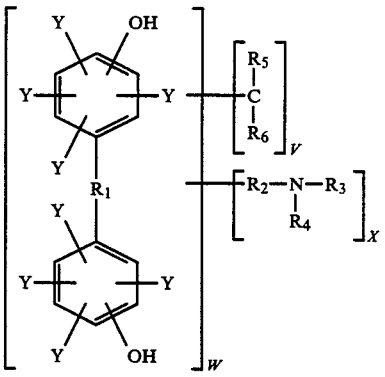

8. The aqueous composition of claim 7 wherein said material is the reaction product of a 2,2-bis[4 hydroxphenyl]propane, N-methyl ethanolamine and formaldehyde.

9. The aqueous composition of claim 7 wherein said material is the reaction product of a 2,2-bis[4 hydroxphenyl]butane, N-methyl ethanolamine and formaldehyde.

10. An aqueous composition according to claim 7 including from about 0.01% to 5% by weight of a polymeric material.

11. An aqueous composition according to claim 7 including from about 0.025% to 1% by weight of a polymeric material.

12. An aqueous composition according to claim 7 further including an acid.

* * * * *